US007490502B2

(12) United States Patent
Pauty et al.

(10) Patent No.: US 7,490,502 B2
(45) Date of Patent: Feb. 17, 2009

(54) PUNCH FOR COLD FORMING OPERATIONS

(75) Inventors: Emmanuel Pauty, Echirolles (FR); Henrik Nordenström, Coventry (GB); Victor Rimbau, Barcelona (ES)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/003,326

(22) Filed: Dec. 21, 2007

(65) Prior Publication Data

US 2008/0156062 A1 Jul. 3, 2008

(30) Foreign Application Priority Data

Dec. 27, 2006 (SE) ..... 0602813
Nov. 16, 2007 (SE) ..... 0702578

(51) Int. Cl.
*B21D 37/00* (2006.01)
*C22C 29/06* (2006.01)

(52) U.S. Cl. ..... 72/347; 72/273; 72/370.01; 72/373; 72/379.2; 76/107.1; 140/105; 407/119

(58) Field of Classification Search ..... 72/347, 72/370.01, 373, 273, 379.2; 76/107.1; 140/105; 407/119

See application file for complete search history.

(56) References Cited

U.S. PATENT DOCUMENTS 3,682,577 A * 8/1972 Smith ..... 72/479
5,054,308 A * 10/1991 Asai et al. ..... 72/463
5,406,825 A * 4/1995 Horie et al. ..... 72/358
5,582,215 A * 12/1996 Yamamoto et al. ..... 72/462
5,736,658 A 4/1998 Mirchandani et al.
6,431,800 B1 * 8/2002 Suzuki ..... 407/119
6,823,705 B2 * 11/2004 Fukuda et al. ..... 72/379.2
7,217,328 B2 * 5/2007 Nishiuchi et al. ..... 148/302

FOREIGN PATENT DOCUMENTS

EP 1 557 230 7/2007
JP 3-258424 11/1991

* cited by examiner

*Primary Examiner*—David B Jones
(74) *Attorney, Agent, or Firm*—Drinker Biddle & Reath LLP

(57) ABSTRACT

A cemented carbide tool containing tungsten carbide, titanium carbide, niobium carbide, possibly TaC, cobalt, chromium and possibly nickel, iron, molybdenum is disclosed. The composition of the materials provides a lighter material than usual, combined with a good resistance to corrosion as well as high hardness and wear resistance. These properties are particularly interesting for the manufacture of punch tools for cold forming operations. Cold forming tools made with these materials will have much better performance, particularly more steady performance and much longer lifetime. A method of cold forming and drawing, particularly deep drawing and ironing process of aluminum and steel beverage can manufacturing, is also disclosed.

12 Claims, No Drawings

PUNCH FOR COLD FORMING OPERATIONS

RELATED APPLICATION DATA

This application claims priority under 35 U.S.C. §119 and/or §365 to Swedish patent application No. 0602813-8, filed Dec. 27, 2006, and also to Swedish patent application No. 0702578-6, filed Nov. 16, 2007, the entire contents of each of these applications are incorporated herein by reference.

FIELD

The present disclosure relates to an improved cemented carbide tool for shaping or otherwise working materials, specifically tools used in the manufacture of two-piece beverage cans.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

A two-piece can is made by a drawing and wall ironing process. In general, a two-piece can is made by stamping out metal discs from a metal plate. A metal "cup" is formed from the disk. The formed cups are pushed through a body-forming die comprising a plurality of annular rings, generally known as draw, redraw, and ironing rings, by a body-forming punch. The clearances between the body-forming punch and the plurality of rings become progressively smaller, so that the thickness of cup wall is reduced and the cup is elongated. This process is generally referred to as the ironing operation. It is a particularly demanding operation causing high wear on the tools and the operation is sensitive to the dimensional changes and lubrication conditions. Because of the tremendous volume of beverage cans manufactured each year, each slight improvement in the manufacturing process can result in tremendous savings.

Tools for imparting a desired shape, form, or finish to a material, such as dies, punches, and the like, must be characterized by extreme hardness, compressive strength and rigidity. This is particularly necessary when shaping metals or similar materials. Commercial material working tools for mass production must also be resistant to wear, erosion and chipping from repeated and continuous stress and abrasion. In addition, these tools should also exhibit good corrosion resistance properties in order not to be damaged by the surrounding liquid media (coolant/lubricant).

On top of these properties, others are of great importance for the punching tools. As this kind of tool is moving very rapidly, any reduction of the weight will result in huge improvements, both in term of cost and life time of the tools. Indeed, if the tool is lighter, less energy is required to run the process and the bending of the ram is reduced. This later effect results in a much better alignment of the punch within the tool-pack and less damages to the antagonist tool; the ironing dies. As a consequence, both tools (punch & dies) will be less damaged during the process due to the reduction of the bending effect.

These tools must also be made from materials which can be designed and machined to close tolerances and maintain dimensional stability over a wide range of operating conditions.

A possible way to improve wear and corrosion resistance is described in JP 3-258424 by the addition of 0.16-0.48 wt-% chromium to the binder phase and having a dispersed fine grained phase of tungsten carbide and tantalum carbide.

Another possible way to achieve both wear and corrosion resistance combined with a reduction of the material density is described in U.S. Pat. No. 5,736,658. This is linked to the use of a nickel based alloy that exhibit a better corrosion resistance and to the addition of titanium carbide, being a lighter material than tungsten carbide. However the benefit is also limited as the binder phase could be even more wear resistant than a nickel based material. In addition, the wear resistance is significantly improved by increasing the target hardness level. A hardness goal of 88 to 91 Ra (corresponding to about 1150 to 1450 HV30) is mentioned to ensure a wear resistance level approximately equivalent to the standard grades. Finally, as no cobalt is added to the binder phase, the grade is non magnetic, which could be a critical drawback for the can maker that request magnetic materials for the punch tool.

EP 1 557 230 discloses a cemented carbide body of 10-12 wt-% Co, <3 wt-% TaC, 1-5.5 wt-% NbC, 3-5 wt-% TiC and remainder WC, particularly useful for metal cutting operations requiring high wear resistance, high edge retention and high edge toughness.

However, so far the conventional cemented carbide seems to keep its position as preferred material. This is mainly medium/coarse grades with about 11 wt-% of cobalt binder or 9 wt-% of alloyed nickel based binder when non magnetic properties are required. Both grades exhibit hardness in good agreement with that mentioned above (1250 and 1375 HV30, respectively).

SUMMARY

It is an object of the present disclosure to provide a tool for cold forming and drawing operations particularly in the manufacture of two-piece beverage aluminum or steel cans by the use of corrosion resistant binder combined with finer tungsten carbide and gamma phase, giving better properties than prior art tools.

An exemplary embodiment of a punch for manufacturing of aluminum or steel beverage cans comprises a cemented carbide consisting essentially of, in wt-%: 70 to 90 WC having an average grain size of <2 μm, 2 to 8 TiC, 1 to 9 NbC, 0 to 3 TaC, and 5 to 20 binder phase, wherein the binder phase includes, in wt-%, 10 to 98 Co, 0 to 50 Ni, 2 to 15 Cr, 0 to 50 Fe and 0 to 10 Mo.

An exemplary method of manufacturing of aluminum or steel beverage cans comprises a deep drawing or an ironing operation utilizing a punch, wherein the punch includes a cemented carbide consisting essentially of, in wt-%: 70 to 90 WC having an average grain size of <2 μm, 2 to 8 TiC, 1 to 9 NbC, 0 to 3 TaC, and 5 to 20 binder phase, wherein the binder phase includes, in wt-%, 10 to 98 Co, 0 to 50 Ni, 2 to 15 Cr, 0 to 50 Fe and 0 to 10 Mo.

An exemplary method of manufacturing of a tubular casing comprises a deep drawing or an ironing operation utilizing a punch, wherein the punch includes a cemented carbide consisting essentially of, in wt-%: 70 to 90 WC having an average grain size of <2 μm, 2 to 8 TiC, 1 to 9 NbC, 0 to 3 TaC, and 5 to 20 binder phase, wherein the binder phase includes, in wt-%, 10 to 98 Co, 0 to 50 Ni, 2 to 15 Cr, 0 to 50 Fe and 0 to 10 Mo.

It is to be understood that both the foregoing general description and the following detailed description are exemplary and explanatory and are intended to provide further explanation of the invention as claimed.

DETAILED DESCRIPTION

It has now surprisingly been found that a punch for cold forming and drawing operations, particularly for deep drawing and ironing operations, with a better performance than prior art tools can be obtained if the punch is made of a cemented carbide consisting essentially of, in wt-%: 70-90, preferably 75-85, WC, 2-8, preferably 2-6, most preferably 3-5, TiC, 1-9, preferably 2-7, NbC, 0-3, preferably 0-1, TaC and 5-20, preferably 8-13, binder phase of Co with an addition of Cr and possibly one or more of the elements selected from Ni, Fe and Mo. More particularly the binder composition is, also in wt-%: 10-98 Co, 0-50 Ni, 2-15 Cr, 0-50 Fe and 0-10 Mo.

In certain embodiments, the sole components of the cemented carbide are those listed above, along with any normal minor impurities.

The cemented carbide structure comprises

WC with an average grain size of <2 μm, preferably 0.3-1.5 μm, gamma phase with an average grain size of 0.5 to 5 μm.

The material has a hardness of 1500-1800 HV30 depending on the selected composition.

In one embodiment, the cemented carbide consists of, in wt-%: 70-90, preferably 75-85, WC, preferably having an average grain size of 0.8-1.2 μm or, alternatively, 0.3-0.5 μm, 2-8, preferably 2-6, most preferably 3-5, TiC, 1-9, preferably 2-7, NbC and 5-20, preferably 8-13, binder phase consisting of, in wt-%: 25-60 Co, 5-15 Cr and 35-50 Ni.

In another embodiment, the cemented carbide consists of, in wt-%: 70-90, preferably 75-85, WC, preferably having an average grain size of 0.3-0.5 μm, 2-8, preferably 2-6, most preferably 3-5, TiC, 1-9, preferably 2-7, NbC and 5-20, preferably 8-13, binder phase consisting of, in wt-%: 10-30 Co, 5-15 Cr, 25-45 Ni, 25-45 Fe and 1-10 Mo.

In yet another embodiment, the cemented carbide consists of, in wt-%: 70-90, preferably 75-85, WC, preferably having an average grain size of 0.8-1.2 μm, 2-8, preferably 2-6, most preferably 3-5, TiC, 1-9, preferably 2-7, NbC and 8-14, preferably 9.5-12.5, binder phase consisting of, in wt-%: 95-97 Co and 3-5 Cr.

The cemented carbide used is prepared from powders forming the hard constituents and powders forming the binder, which are wet milled together, dried, pressed to bodies of desired shape and sintered.

One important feature relates to the use of specific binder designs to get very good corrosion resistance of the cemented carbide against the coolant/lubricant used in the field. In order to keep enough magnetic properties, this alloyed binder always contains a significant amount of cobalt. In addition it contains chromium, and possibly also nickel, molybdenum and iron.

The cemented carbide exhibits a high hardness in order to reach a high wear resistance. This is obtained via the combination of the use of very fine tungsten carbide and the addition of a cubic carbide, so called gamma phase. This later phase contains titanium carbide and niobium carbide, and possibly a small amount of tantalum carbide. In addition, the binder content is high enough to keep a high toughness of the materials suitable for the punching of the metallic disc material density, as shown by Example 1.

EXAMPLE 1

Four cemented carbide bodies according to the invention with the composition according to Table 1 below, were prepared and characterized (Sample C to F). Prior art A & B are Sandvik's standard grades for Draw and Wall Ironing (DWI) operations. Sample A has a medium-coarse grain size with 11 wt-% binder (cobalt based) that exhibits magnetic properties, while B has a medium-coarse grain size with 9 wt-% of binder (nickel based) that does not exhibit magnetic properties. As a consequence, A is used when magnetic grade is required while B is used when non magnetic grade is needed.

TABLE 1

(in weight-%):

| | Sample | | | | | |
|---|---|---|---|---|---|---|
| | A prior art | B prior art | C invention | D invention | E invention | F invention |
| WC | 89.0 | 90.94 | 78.48 | 77.69 | 80 | 80.03 |
| TiC | 0 | 0 | 4.0 | 4.0 | 4.0 | 4.0 |
| NbC | 0 | 0 | 5.87 | 6.66 | 6.0 | 6.0 |
| Co | 11 | 0 | 11.22 | 5.4 | 4.64 | 1.78 |
| Ni | 0 | 8.02 | 0 | 5.07 | 4.36 | 3.56 |
| Fe | 0 | 0 | 0 | 0 | 0 | 3.56 |
| Mo | 0 | 0.28 | 0 | 0 | 0 | 0.3 |
| Cr | 0 | 0.76 | 0.43 | 1.18 | 1.0 | 0.77 |
| d WC(μm) | 3.5 | 4 | 1 | 1 | 0.4 | 0.4 |

The properties have been measured according to the standard used in the cemented carbide field i.e. ISO 3369:1975 for the density, ISO 3878:1983 for the hardness and ATM B611-85 for the abrasion wear resistance.

The corrosion resistance has been characterized using an immersion test in a real lubricant formulation (used for the body maker) diluted to 3 wt-% in demineralized water. The immersion was performed during 15 days at 50° C., which correspond to the lubricant temperature during the DWI process. The weight of the cemented carbide sample was measured before and after the immersion. The results are presented in Table 2 below.

TABLE 2

| | Sample | | | | | |
|---|---|---|---|---|---|---|
| | A prior art | B prior art | C in-vention | D in-vention | E invention | F invention |
| Density ($g/cm^3$) | 14.4 | 14.6 | 12.7 | 12.5 | 12.7 | 12.6 |
| Hardness (HV30) | 1250 | 1375 | 1550 | 1520 | 1735 | 1750 |
| Wear resistance ($cm^{-3}$) | 8 | 10 | 23 | 13.1 | 53 | 22.8 |
| Weight evolution (mg) | −8 | −3 | −4 | 0 | −2 | −3 |

Thus compared to prior art A, the invention exhibits many improvements (for all the parameters) as shown in Table 3 below.

TABLE 3

| | (% improvement) Sample | | | |
|---|---|---|---|---|
| | C | D | E | F |
| Density (g/cm$^3$) | −11.8 | −13.2 | −11.8 | −12.5 |
| Hardness | +24 | +21.6 | +38.8 | +40 |
| Wear resistance | +187.5 | +63.75 | +562.5 | +185 |
| Weight evolution | −50 | −100 | −75 | −62.5 |

To conclude, the density is reduced by more than 10% and the hardness is increased by more than 20%. The wear resistance is increased by more than 60 to more than 500%. The corrosion resistance is strongly improved as the weight loss, due to the leaching, is reduced by more than 50%.

Compared to prior art B (which is a corrosion resistant grade), the invention exhibits also many improvements as shown by Table 4 below.

TABLE 4

| | (% improvement) Sample | | | |
|---|---|---|---|---|
| | C | D | E | F |
| Density | −13 | −14.4 | −13 | −13.7 |
| Hardness | +12.7 | +10.5 | +26.2 | +27.3 |
| Wear resistance | +130 | +31 | +430 | +128 |
| Weight evolution | +33 | −100 | −33 | 0 |

From the table it can be seen that the density is reduced by more than 10% and the hardness is increased by more than 10%. The wear resistance is increased by more than 30 to more than 400%. The corrosion resistance is slightly improved or close to the one of the reference B, which is consistent with the fact that the reference B exhibits already good corrosion resistance properties.

Thus, compared to prior art A or B, the invention exhibits much better properties (between above 10 to more than 500%).

EXAMPLE 2

Punches made according to Sample C from Example 1 were produced and tested for aluminum can production. Punches made with a Sandvik premium grade were also been made and tested at the same time in order to quantify the improvement compared to Sample C. It should be noted that the premium grade behavior is better than the one of prior art Sample A & B in Example 1. Thus the benefit of the invention is even more important if comparing with prior art A & B.

In total, 2 punches of the grade according to Sample C and 5 punches of Sandvik premium grade, respectively, were tested. More precisely, the test for each punch included monitoring and recording the number of cans produced before regrinding was necessary, in order to restore the punch to acceptable shape and dimension. The test continued until reconditioning was no longer possible.

From these recordings the minimum number of cans produced, the maximum number of cans produced, the average minimum number of cans produced per grade, the average maximum number of cans produced per grade and the average total production of cans per punch were determined.

Table 5 below summarizes the improvement of Sample C according to the invention compared to the Sandvik premium grade.

TABLE 5

| | |
|---|---|
| Maximum no. of cans | +120.7% |
| Minimum no. of cans | +628.1% |
| Average maximum no. of cans | +111.9% |
| Average minimum no. of cans | +748.4% |
| Average no. of cans (per grade) | +128.6% |

Thus, compared to the Sandvik premium grade, the invention exhibits much higher production level. The behavior is much more stable since the minimum number of cans has been multiplied by more than 6, and the global average production has been multiplied by more than 2.

The disclosure also relates to the use of a punch of a cemented carbide according to the above, with complex hard phase and corrosion resistant binder resulting in a lighter material exhibiting a high hardness, improved wear and corrosion resistance in cold forming and drawing operations, particularly in the deep drawing and ironing process of aluminum and steel beverage can manufacturing. However, the disclosed punch and method have broad applicability for use in manufacturing a variety of other shaped articles, particularly tubular casings, such as dry cell battery casings and aerosol cans.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A punch for manufacturing of aluminum or steel beverage cans, comprising a cemented carbide consisting essentially of, in wt-%:

70 to 90 WC having an average grain size of <2 μm;

2 to 8 TiC;

1 to 9 NbC;

0 to 3 TaC; and 5 to 20 binder phase, wherein the binder phase includes, in wt-%, 10 to 98 Co, 0 to 50 Ni, 2 to 15 Cr, 0 to 50 Fe and 0 to 10 Mo.

2. The punch according to claim 1, wherein the cemented carbide consists essentially of, in wt-%: 75 to 85 WC, 2 to 6 TiC, 2 to 7 NbC, 0 to 1 TaC and 8 to 13 binder phase.

3. The punch according to claim 1, wherein the cemented carbide consists of, in wt-%: 70 to 90 WC, 2 to 8 TiC, 1 to 9 NbC and 5 to 20 binder phase, and wherein the binder phase consists of, in wt-%: 25 to 60 Co, 35 to 50 Ni and 5 to 15 Cr.

4. The punch according to claim 3, wherein the cemented carbide consists of, in wt-%: 75 to 85 WC, 2 to 6 TiC, 2 to 7 NbC and 8 to 13 binder phase, and wherein the binder phase consists of, in wt-%: 25 to 60 Co, 35 to 50 Ni and 5 to 15 Cr.

5. The punch according to claim 1, wherein the cemented carbide consists of, in wt-%: 70 to 90 WC, 2 to 8 TiC, 1 to 9 NbC and 5 to 20 binder phase, and wherein the binder phase consists of, in wt-%: 10 to 30 Co, 5 to 15 Cr, 25 to 45 Ni, 25 to 45 Fe and 1 to 10 Mo.

6. The punch according to claim 5, wherein the cemented carbide consists of, in wt-%: 75 to 85 WC, 2 to 6 TiC, 2 to 7 NbC and 8 to 13 binder phase, and wherein the binder phase consists of, in wt-%: 10 to 30 Co, 5 to 15 Cr, 25 to 45 Ni, 25 to 45 Fe and 1 to 10 Mo.

7. The punch according to claim 1, wherein the cemented carbide consists of, in wt-%: 70 to 90 WC, 2 to 8 TiC, 1 to 9 NbC and 8 to 14 binder phase, and wherein the binder phase consists of, in wt-%: 95 to 97 Co and 3 to 5 Cr.

8. The punch according to claim 7, wherein the cemented carbide consists of, in wt-%: 75 to 85 WC, 2 to 6 TiC, 2 to 7 NbC and 9.5 to 12.5 binder phase, and wherein the binder phase consists of, in wt-%: 95 to 97 Co and 3 to 5 Cr.

9. A method of manufacturing of aluminum or steel beverage cans, the method comprising:

a deep drawing or an ironing operation utilizing a punch, wherein the punch includes a cemented carbide consisting essentially of, in wt-%:

70 to 90 WC having an average grain size of <2 μm, 2 to 8 TiC, 1 to 9 NbC, 0 to 3 TaC, and 5 to 20 binder phase, wherein the binder phase includes, in wt-%, 10 to 98 Co, 0 to 50 Ni, 2 to 15 Cr, 0 to 50 Fe and 0 to 10 Mo.

10. A method of manufacturing of a tubular casing, the method comprising:

a deep drawing or an ironing operation utilizing a punch, wherein the punch includes a cemented carbide consisting essentially of, in wt-%:

70 to 90 WC having an average grain size of <2 μm, 2 to 8 TiC, 1 to 9 NbC, 0 to 3 TaC, and 5 to 20 binder phase, wherein the binder phase includes, in wt-%, 10 to 98 Co, 0 to 50 Ni, 2 to 15 Cr, 0 to 50 Fe and 0 to 10 Mo.

11. The method according to claim 10, wherein the tubular casing is a dry cell battery casing.

12. The method according to claim 10, wherein the tubular casing is an aerosol can.

* * * * *